United States Patent [19]

Faulkner et al.

[11] 4,188,287

[45] Feb. 12, 1980

[54] SLOW SPEED WEDGE BAR FLOTATION MIXING DEVICE

[75] Inventors: Bobby P. Faulkner; Donald C. Moore, both of New Berlin, Wis.

[73] Assignee: Allis-Chalmers Corporation, Milwaukee, Wis.

[21] Appl. No.: 960,223

[22] Filed: Nov. 13, 1978

Related U.S. Application Data

[63] Continuation-in-part of Ser. No. 849,674, Nov. 8, 1977, abandoned.

[51] Int. Cl.[2] ..... B03D 1/20

[52] U.S. Cl. ..... 209/168; 261/88

[58] Field of Search ..... 209/168–170, 209/164; 210/44, 221 P; 261/87–88

[56] References Cited

U.S. PATENT DOCUMENTS

| | | | |
|---|---|---|---|
| 1,445,935 | 2/1923 | Daman et al. | 209/169 |
| 1,711,326 | 4/1929 | Remick | 209/170 |

*Primary Examiner*—Robert Halper
*Assistant Examiner*—Jon E. Hokanson
*Attorney, Agent, or Firm*—Robert C. Jones

[57] ABSTRACT

Aeration flotation bar comprising a shaft mounted in a tank for rotation about a vertical axis and having a plurality of wedge configured bar members. Air through the shaft is distributed lengthwise through each wedge bar member simultaneously and from each wedge bar member is emitted as a fine jet through multiple jet bores formed in the trailing surface of the wedge bars. The fine air jets create a large mass of fine air bubbles which in the aggregate provide more surface for material such as coal or other flotable materials to adhere to thereby increasing the reclamation output of the tank or cell and increasing the efficiency of the tank or cell. In addition, the location of the fine jets are such that the fine air jet streams act on the area of the tank or cell where sanding is most likely to occur and thus eliminate or minimize the sanding tendency.

3 Claims, 2 Drawing Figures

SLOW SPEED WEDGE BAR FLOTATION MIXING DEVICE

This application is a continuation-in-part of Ser. No. 849,674 filed Nov. 8, 1977, now abandoned.

BACKGROUND OF THE INVENTION

Flotation apparatus and processes respond to changing conditions resulting from depletion of high grade material sources, such as coal, along with a rising demand for the material. Also, rising cost factors have increased attempts to expand the production ability of the flotation apparatus. Another problem area is fine particle processing for known apparatus which has not been particularly suitable for this purpose. It has been suggested that air bubble formation at the impeller is at the point at which hydrophobic particles apparently attach to the bubbles in that region. The production of air bubbles has been thought of as a process of forcing a division of large bubbles into smaller bubbles. It has also been considered that in the generation of fine air bubbles the addition of reagents is more important than distribution and that velocity of the distributor may also be regarded as a prime cause of the production of fine air bubbles or at least an important cause of fine air bubbles.

In a state of the art article, published in the Minerals Science Engineering Vol. 9, No. 3, July 1977, it is stated "Good mixing promotes particle-bubble contact and thus particle-bubble adhesion. Too much mixing, however, would detach particles from the air bubbles. If the degree of mixing were too low the particles would not have the kinetic energy required to attach to the air bubbles. Thus the degree of mixing in the pulp is important." In the same article, as a conclusion, it is stated "It is likely that improved productivity of flotation cells handling very fine particles could come about by using bubbles that are smaller than those customarily produced in flotation machines. There is clearly a need to be able to make bubbles in the range of 100 to 500 um in diameter in a simple controllable way, these sizes being beyond the capabilities of conventional turbine agitators and air diffusers."

It has been found that in the removal of the desirable materials from a slurry it is important to produce a mass of fine air bubbles with extremely low rotational speed of the distributor. It has also been found that important benefits are obtained if sanding in the area of the distributor is minimized so that the sanding condition cannot interfere with bubble production. Prior apparatuses of the flotation type have had some serious disadvantages. For example, prior apparatuses of relatively good efficiency have been complicated in construction which resulted in higher cost both in assembly and in the disassembly for maintenance purposes. Known flotation cell mechanisms utilize excessive agitation which is similar to the action experienced in a pump. This type of mixing greatly increases the probability of refuse entrapment which is of course detrimental to high yields required in present day flotation cells. Also, known apparatuses require higher power input, thereby further increasing the operating cost of the cells. On the other hand, apparatuses of simpler construction have not been efficient, thereby increasing production cost and requiring the installation of more units for a given production requirement.

SUMMARY OF THE INVENTION

Tests have been conducted on the apparatus of the present invention which show that the apparatus of the wedge-shaped rotating distributor rotating at speeds from 75 to 90 RPM and having an aspect ratio (distributor size to tank width) of approximately 0.9 with air pressure from 13.0 to 20.5 kPa (1.9 to 3.0 PSI) provides optimum flotation cell results.

The results of various tests are shown in the following tabulation:

| Test | Air Pressure | % Weight | | Percent Distribution Pyritics | Percent Distribution Ash |
|---|---|---|---|---|---|
| A | 93 P.S.I. | Concentrate | 86.5 | 58.2 | 51.2 |
| | | Tailings | 13.5 | 41.8 | 48.8 |
| B | 27 P.S.I. | Concentrate | 81.8 | 67.6 | 50.8 |
| | | Tailings | 18.2 | 32.4 | 49.2 |
| C | 3 P.S.I. | Concentrate | 58.8 | 39.3 | 33.3 |
| | | Tailings | 41.2 | 60.7 | 66.7 |
| D | 1.9 P.S.I. | Concentrate | 66.6 | 37.5 | 19.0 |
| | | Tailings | 33.4 | 62.5 | 81.0 |

With the above conditions, in a coal flotation test, up to 76% of the ash and pyritic sulfur were rejected while recovering 93% of the BTU valve present in the feed. With the present apparatus, typical feed sizes, which range from 80% passing 35 mesh, to 80% passing 270 mesh and pulp densities in a range of 1.4% up to 10% solids have not posed any significant problems. It has also been found that with the present apparatus coal feeds which contain up to 24% ash and 1.14% pyritic sulfur floated successfully. Tests have shown that with a distributor speed of between 75 to 90 RPM, the bubble size decreased by approximately one-third, which is highly desirable. Additional benefits have also resulted, at a distributor speed of between 75 and 90 RPM, in that it improves refuse rejections and also decreases the wear rate of the cell and the distributor.

| Test | Impeller Speed | % Weight | | Percent Distribution Pyritics | Percent Distribution Ash |
|---|---|---|---|---|---|
| A | 60 R.P.M. | 66.6 | | 37.5 | 19.0 |
| | | Tailings | 33.4 | 62.5 | 81.0 |
| B | 78 R.P.M. | Concentrate | 79.3 | 47.3 | 22.1 |
| | | Tailings | 20.7 | 52.7 | 77.9 |
| C | 88 R.P.M. | Concentrate | 78.6 | 38.3 | 24.2 |
| | | Tailings | 21.4 | 61.7 | 75.8 |
| D | Speeds of 172, 118, 31 and 23 R.P.M.'s were tried but these speeds produced very little froth and/or excessive agitation. | | | | |

It is the general object of the present invention to provide a relatively simple and highly efficient method and an apparatus for producing a fine air bubble mass in a flotation apparatus.

Another object of the present invention is to provide flotation apparatus which is readily controllable to suit the most desirable conditions and accomplished by being able to form discrete bubble diameter by independent control of air volume, speed and agitation.

Still another object of the present invention is to provide a method and an apparatus for forming a mass of fine air bubbles in a flotation apparatus which does not depend on shearing relatively large air bubbles to produce the fine air bubbles.

Yet another object of the present invention is to provide a method and an apparatus for forming a large mass of relatively fine air bubbles in a subaeration process at a relatively slow speed.

A still further object of the present invention is the creation of fine air bubbles in a flotation cell without any pumping or mixing action.

A further object of the present invention is to provide apparatus for a flotation cell which operates efficiently with reduced power input to the cell.

Yet another object of the present invention is to provide apparatus which is capable of generating fine bubbles with less turbulence to provide opportunity for greater selectivity.

A further object of the present invention is to provide a distributor for a flotation apparatus having a plurality of blades wherein each blade is of a wedge-shape configuration and incorporating a plurality of air stream expulsion jets in the trailing edge of each blade.

A still further object of the present invention is to provide a distributor for a flotation apparatus having a plurality of wedge configured blades and incorporating a plurality of air stream jets in the trailing edge thereof and orientated in a manner to form a mass of fine air bubbles and also to minimize sanding in the area of the distributor.

Another object of the present invention is to provide an improved apparatus to effectively separate very fine micron mineral and gangue constituents, such as coal and ash, as well as other processes which require aeration as a means of separating or classifying from a medium.

DESCRIPTION OF THE INVENTION

FIG. 1 is a view partly in elevation and partly in section through a single cell flotation device showing the wedge configured distributor; and, FIG. 2 is a plan view of the distributor of FIG. 1 taken in a plane represented by the line II—II in FIG. 1.

DESCRIPTION OF THE PREFERRED EMBODIMENT

Figure 1:
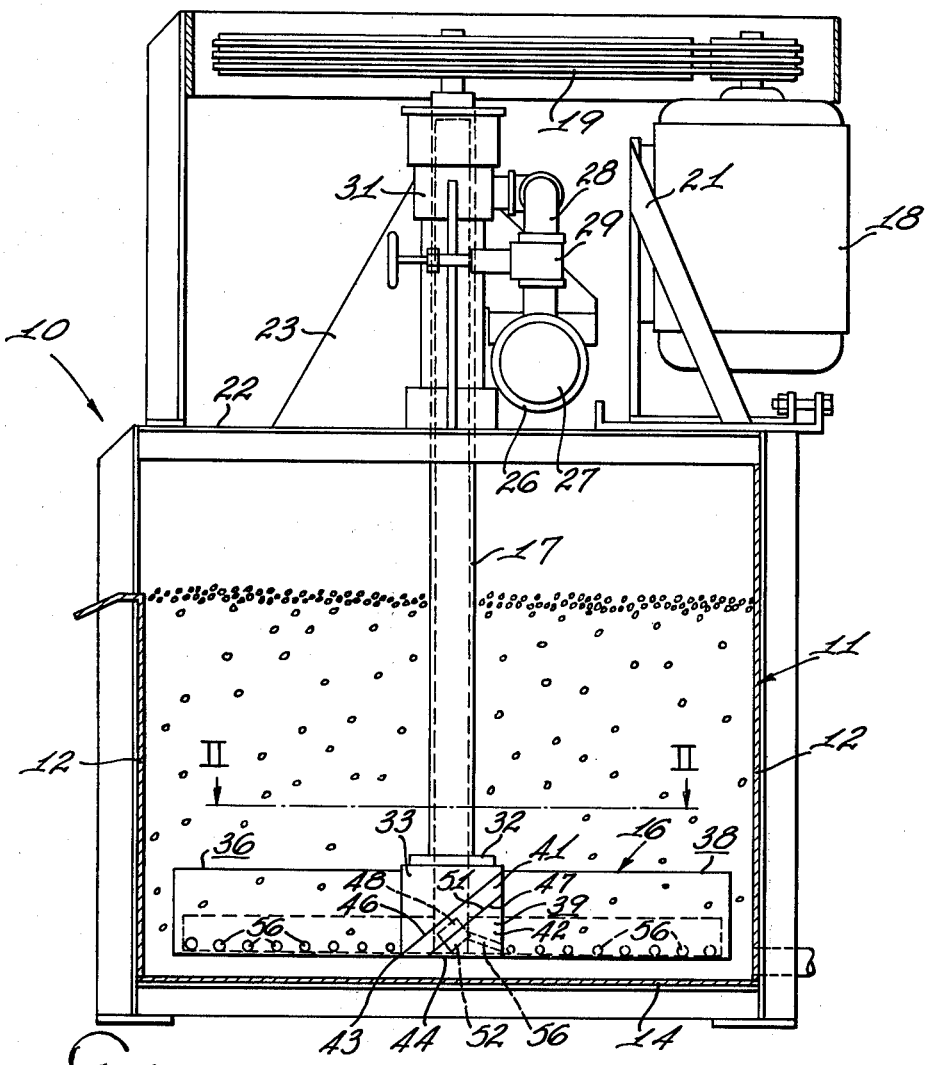

The illustrated flotation apparatus 10 includes a tank 11 formed by side walls 12 and a bottom wall or base 14. The apparatus 10 includes a distributor 16 which is fixed to the depending end of a hollow shaft 17 for rotation about the vertical axis of the shaft. The shaft 17 is power driven by operation of a motor 18 driving through a belt transmission 19 connected to drive the shaft 17. The motor 18 is carried by a bracket 21 which is mounted on tank top structure 22. A bracket 23 supports the upper end of the shaft 17 and also mounts an air compressor 26 operated by a connectd motor 27. The compressor 26 is connected by suitable piping 28 and a regulating valve 29 to a manifold 31 which surrounds the upper end of shaft 17. Thus, air from the compressor 26 is directed through the regulating valve 29 into the manifold 31 and thence through suitable communicating openings (not shown) formed in the upper end of the shaft 17 into the bore of the shaft and is available for distribution to the distributor 16.

The lower end of the hollow drive shaft 17 is provided with a mounting flange 32 to which a distributor manifold block 33 is secured. Extending outwardly from the manifold block 33 are four horizontal arms or blades 36, 37, 38 and 39 that are spaced 90 degrees apart from each other. It has been found that with an aspect ratio of 0.7 to 0.9, that is the ratio of the distributor size to cell width, a very desirable result is obtained in that very fine bubbles are produced, good distribution and good flotation occurred.

Figure 2:
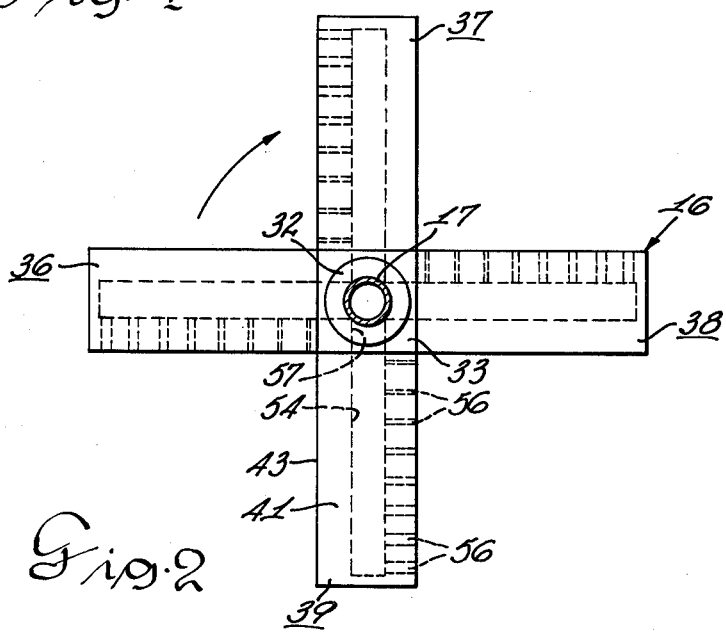

As shown in FIG. 1, the blades are identical and each presents a triangular configuration as viewed in end elevation and exemplified by the blade 39. As shown, the blade 39 in the preferred arrangement is formed of two elongated members 41 and 42 having closing mating surfaces. The member 41 is in the form of a trapezoid. The member 42 is in the form of a right angle triangle. When assembled, the members 41 and 42 cooperate to form a right angle triangle or a wedge configured blade, which is preferred, the leading edge 43 of which is formed by the base surface 44 and the hypotenuse surface 46. While the wedge configured blades 36, 37, 38 and 39 are shown as having in cross section the configuration of a right triangle with the surfaces 46 at a 45 degree angle with respect to the bottom of the cell, as the one configuration which is an upper limit, it is to be understood that the blades could be so configured that the surface 46 would be at an angle of 30 degrees with respect to the cell bottom, which is the lower limit. It has been found that the material in the cell moving upwardly over the sloping surface 46 tends to drop off the edge and fall behind the trailing edge and is agitated by the fine air bubbles produced by air from the jets 56. The greater the angle of the wedge the vertical dimension of the trailing surface increases, and the turbulence increases. As the angle of the wedge decreases, of course, the vertical dimension of the trailing surface decreases and the turbulence decreases. The most efficient wedge configuration has been found to be between 30 and 45 degrees wherein relatively mild turbulence is created yet sufficient enough to agitate the material without creating a condition that causes violent collision of materials, which is self defeating. Violent collision between particles interferes with the flotation action and reduces the efficiency of the cell. The surface 47 of the member 41 is provided with an elongated milled groove 48 therein. The groove 48 extends from a point short of the free end of the blade member 41 to the opposite inner end. In a similar manner, the surface 51 of the blade member 42 is provided with a longitudinally extending groove 52 which is complementary to the groove 48. When the members 41 and 42 are mated and secured together, the mating grooves 48 and 52 form a blind end channel 54, as indicated in FIG. 2. As shown, the blade member 42 is provided with a plurality of laterally extending jet bores 56 which are drilled upwardly from the lower trailing edge of the blade member to intersect with the passage 54. The assembled blade 39 is secured to the distributor manifold 33 and in such position, the blade channel 54 communicates with a bore 57 formed in the manifold 33. It will be appreciated that the foregoing description of the distributor blade 39 also applies to the blades 36, 37 and 38. Thus, as the distributor 16 is rotated in a clockwise direction, as viewed in FIG. 2, at a preferred rotational speed of between 75 to 90 RPM, air under pressure from the compressor 26 is supplied to the interior of the hollow shaft 17. The air under pressure flows to the distributor manifold 33 and is distributed laterally to the longitudinally extending channels as exemplified by the channel 54 of blade 39. The air under pressure in the blade channels will expel through the jet bores 56. As indicated, the jet bores 56 are of graduated diameter with the smallest diameter bore being adjacent the manifold end of the blade and the largest diameter bore being at the outer, free end of the blade. Thus, the air under pressure expelling through the bores 56 is regulated so as to provide air bubbles of substantially the same size along the entire length of blades 39. The decisive factor is that the air discharge at a given rotational speed of the distributor, considering the material being processed, will produce fine air bubbles to achieve good flotation conditions. The rotation of the distributor 16 is at a relatively slow speed, which speed is a range of 50 to 100 RPM but more selectively in the range of 60 to 90 RPM, which is the most efficient rotational speed range. The combination of the slow speed of rotation and the air jet streams has been found to purify a coal slurry five times as much as known apparatus. The slow rotation of the distributor also creates a slower material floating condition which, in the case of a coal slurry or fine mineral particles, does not trap unwanted refuse or slag. This is true because adjacent fine air bubbles to which the coal or minerals adhere are constantly moving and any unwanted material that is sandwiched between the coal or mineral particles of adjacent air bubbles can fall out as the fine air bubbles move apart. Also, the slow rotation of the distributor reduces the wear on the blades thereby extending the useful life of the distributor as well as reducing total power requirement.

In subaeration processes, the slurry tends to sand-up below the distributor thereby reducing the effectiveness of the aeration. This is particularly true of flotation units where air is supplied to the slurry around the axis of the drive shaft. In the present invention, the lateral rows of air jets along the length of each blade in combination with the downwardly inclined jets serve to minimize the sanding tendencies of the slurry and thereby increase the efficiency of the system and reduce power consumption. However, if sanding is not a problem the jets or bores 56 in the distributor blades may be constructed in the blades so that their axes are parallel to the bottom of the cell.

It has been found that with the apparatus set forth an air pressure of 1.9 to 3.0 PSI was sufficient for flotation. It was also determined that by providing the blades with at least three jets or air holes 56 per 8 inches of blade increased the yield and also increased the percentage of refuse rejection which is highly desirable. It has also been determined that the rotational speed of the distributor 16 of between 75 and 90 RPM provided the most satisfactory results of froth production. Higher distributor speeds produced excessive agitation with no froth being produced. At speeds below the optimum range, large bubbles are produced and the surface of the cell evidenced great turbulence, resulting in little froth production.

The unexpected results obtained with the present invention in comparison with apparatus presently available is indicated in the following table from "Flotation Machines" by C. C. Harris, November, 1975.

| Commercial Cell | Impeller Speed | Peripheral Speed (ft/min.) | Consumed Power* (hp/ft$^3$×10-2) |
|---|---|---|---|
| A | 165-440 | 950-1400 | 9-22 |
| B | 105-180 | 1100-1300 | 7-10 |
| C | 170-520 | 1250-1300 | 9-42 |
| D | 163-210 | 1400-1480 | 4.4-5.8 |
| E | 380-985 | 900-1250 | 16-47 |
| F | 190-310 | 1300 | 8-9 |
| G | 184-195 | 1460-1550 | 5-9 |
| H | 160-200 | 1030-1250 | 5-7 |
| I | 260-430 | 1200-1900 | 10-13 |
| J | 165-260 | 1700-2300 | 5-8 |
| K | 120-277 | 1280-1320 | 1.6-2.4 |

-continued

| Commercial Cell | Impeller Speed | Peripheral Speed (ft/min.) | Consumed Power* (hp/ft$^3$×10-2) |
|---|---|---|---|
| L | 225-450 | 1670-1780 | 8-12 |
| Present Invention | 88 | 600 | 0.58 (actual) |

*Consumed HP assumed to be 70% of installed power.

The embodiments of the invention in which an exclusive property or privilege is claimed are defined as follows:

1. A distributor for a flotation apparatus comprising:

a vertical hollow drive shaft adapted to receive air under pressure;

a manifold secured to the depending end of said hollow drive shaft for rotation with said drive shaft, said manifold being connected to receive air under pressure from said shaft;

a plurality of distribution ports formed in said manifold to provide communicating passageways from the interior of said manifold to the exterior thereof;

a plurality of horizontally extending blades secured to said manifold;

a longitudinal passageway in each of said blades, the end of the passageways adjacent to said manifold being in communication with an associated manifold distribution port; and, a plurality of individual means along the trailing edge of each of said blades and communicating with the associated longitudinal passage to provide for the discharge of the air under pressure in the passageway to cause a discrete bubble size to be emitted therefrom with low power input, said means being operable to regulate the discharge of air under pressure to provide for the discharge of air under pressure to cause a discrete bubble size to be emitted therefrom so that the bubbles emitted along the entire length of each blade are substantially the same size.

2. A distributor for a flotation apparatus comprising:

a vertical hollow drive shaft adapted to receive said air under pressure;

a manifold secured to the depending end of said hollow drive shaft for rotation with said drive shaft, said manifold being connected to receive air under pressure from said shaft;

a plurality of distribution ports formed in said manifold to provide communicating passageways from the interior of said manifold to the exterior thereof;

a plurality of horizontally extending blades secured to said manifold;

a longitudinal passageway in each of said blades, the end of the passageways adjacent to said manifold being in communication with an associated manifold distribution port;

means along the trailing edge of each of said blades and communicating with the associated longitudinal passage to provide for the discharge of the air under pressure in the passageway to cause a discrete bubble size to be emitted therefrom with lower power input, said means operating to regulate the discharge of air under pressure so that the discharge of air is substantially the same for the entire length of the blade, said means comprising a plurality of air jets constructed with different diameters with the smallest diameter jet being located adjacent said manifold and the largest diameter jet being outboard adjacent the free end of the blade.

3. A distributor for a flotation apparatus comprising:

a vertical hollow drive shaft adapted to receive air under pressure;

a manifold secured to the depending end of said hollow drive shaft for rotation with said drive shaft, said manifold being connected to receive air under pressure from said shaft;

a plurality of distribution ports formed in said manifold to provide communicating passageways from the interior of said manifold to the interior thereof;

a plurality of horizontally extending blades secured to said manifold and in communication with an associated passageway, each of said blades being constructed in a manner to present in cross-section a triangular configuration, each triangular configured blade being formed of two elongated members, one member presenting in cross-section a configuration of a trapezoid and the other member presenting a cross-section the configuration of a triangle;

said members having mating surfaces in which a groove is formed so as to extend from one to a point short of the opposite end, said grooves being arranged so that when the members are in mating engagment the said grooves mate to form a passageway for air under pressure; and, means along the trailing edge of each blade in communication with the passageway in the associated blade, said means being operable to regulate the discharge of air under pressure so that the discharge of air is substantially the same along the entire length of each blade.

* * * * *